United States Patent [19]

Boscardin et al.

[11] 4,221,492

[45] Sep. 9, 1980

[54] TOOTHBRUSH WITH BUILT-IN "SQUEEZABLE" VALVED TOOTHPASTE HOLDER

[76] Inventors: Lucio Boscardin, Camparda, Milan; Stefano Frustagli, Bresso, Milan; Alfredo Veronese, Cinisello Balsamo, Milan, all of Italy

[21] Appl. No.: 856,360

[22] Filed: Dec. 1, 1977

[30] Foreign Application Priority Data

| | | | |
|---|---|---|---|
| Dec. 2, 1976 | [IT] | Italy | 30025 A/76 |
| Dec. 2, 1976 | [IT] | Italy | 30026 A/76 |
| Mar. 3, 1977 | [IT] | Italy | 20790 A/77 |

[51] Int. Cl.[3] ..... A46B 11/02

[52] U.S. Cl. ..... 401/184; 401/186; 401/271; 401/278; 401/288

[58] Field of Search ..... 401/156, 183, 184–186, 401/270–273, 278, 279, 282, 284, 285, 288, 290, 291

[56] References Cited

U.S. PATENT DOCUMENTS

| | | | |
|---|---|---|---|
| 1,726,197 | 8/1929 | Soukup | 401/175 |
| 1,922,204 | 8/1933 | Johnson | 222/494 |
| 2,209,665 | 7/1940 | Scheringer | 222/494 |
| 2,699,888 | 1/1955 | Crane | 222/491 |
| 2,795,000 | 6/1957 | Lomholdt | 401/162 |
| 3,256,894 | 6/1966 | Sherman | 401/278 |
| 3,400,996 | 9/1968 | Vandergrift | 401/184 |
| 3,754,690 | 8/1973 | Marchant | 222/494 |

FOREIGN PATENT DOCUMENTS

| | | | |
|---|---|---|---|
| 2341843 | 2/1975 | Fed. Rep. of Germany | 401/183 |
| 2646457 | 4/1977 | Fed. Rep. of Germany | 401/183 |
| 572394 | 2/1924 | France | 401/156 |
| 1023484 | 12/1952 | France | 401/186 |
| 1,282,995 | 12/1961 | France | 401/183 |

*Primary Examiner*—Clyde I. Coughenour
*Attorney, Agent, or Firm*—Michael J. Striker

[57] ABSTRACT

A brush provided with a hollow handle for containing a supply of material and having a flexible wall for forcing the material past a valve and to the brush bristles at one end and a removable closure at the other end for material supply to the handle.

9 Claims, 14 Drawing Figures

12
X
28
30
32
25
27
29
26
17
11
31
18
15
16
10
13
38
23
43
24
36
21
22
42
44
20
19
14
39
40
38
41
34
35
36

TOOTHBRUSH WITH BUILT-IN "SQUEEZABLE" VALVED TOOTHPASTE HOLDER

We all know the normal cleaning method whereby fluids are spread onto more or less stiffened bristles fixed onto a base, such as brushes, paint brushes and the like. The products generally used with such brushes are kept in suitable tins and are applied to the brush, or to the treated surface, by pouring, dipping or some other method.

A number of systems have been invented to facilitate direct application of the product onto the bristles. In some of those most frequently used, the handles themselves contain the product and connection between the handles and the brush part takes place through internal channels. All the methods used have given rise to various difficulties. For example, where there is a continuous flow between the handle-container and an outlet placed near the bristles:

if liquid products are used, either too little or too much comes out, if pastes are used and plastic containers, some of the paste is left inside or squeezes out through the joints with the filling cap or with the brush, or else there is unhygienic waste of the product through the outlet near the bristles.

The present invention eliminates these troubles as will be explained below.

A plastic device is envisaged formed of three main parts:

- A brush section with an internal channel running along its length connected to an aperture which opens onto the surface where the bristles are fitted;
- A central section with a filling inlet at the bottom end;
- A cap which closes the filling inlet.

The central section includes zones which vary in rigidity and flexibility, according to the longitudinal directions in the aperture connecting it to the brush section and in the open filling aperture within a rigid plastic disk.

The disk and the central section are cast in one piece. In the part between the container and the paste outlet, and also at the other end of the container, automatic vales are placed. Their arrangement and type are such that when pressure is exercised inside the container, the first valve opens while the second one either closes or stays closed. When a depression is created the first valve closes or stays closed, and the second one opens.

The attached diagrams show some examples of how the device works.

Figure 11:
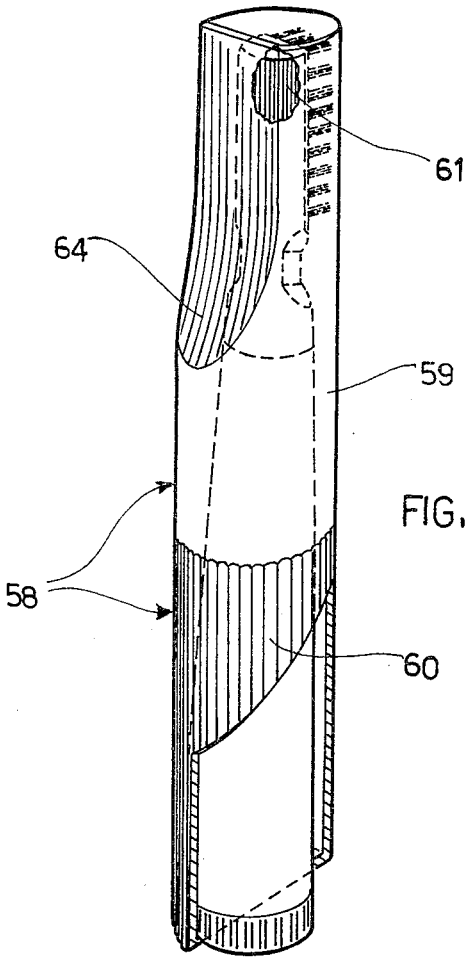
Figure 11:
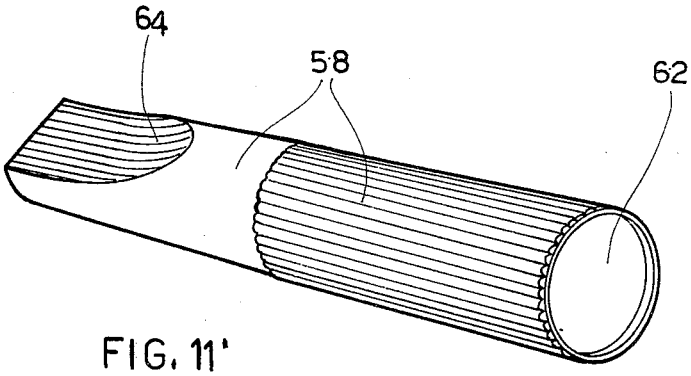

FIGS. 11 and 11' are views of a toothbrush case.

Figure 12:
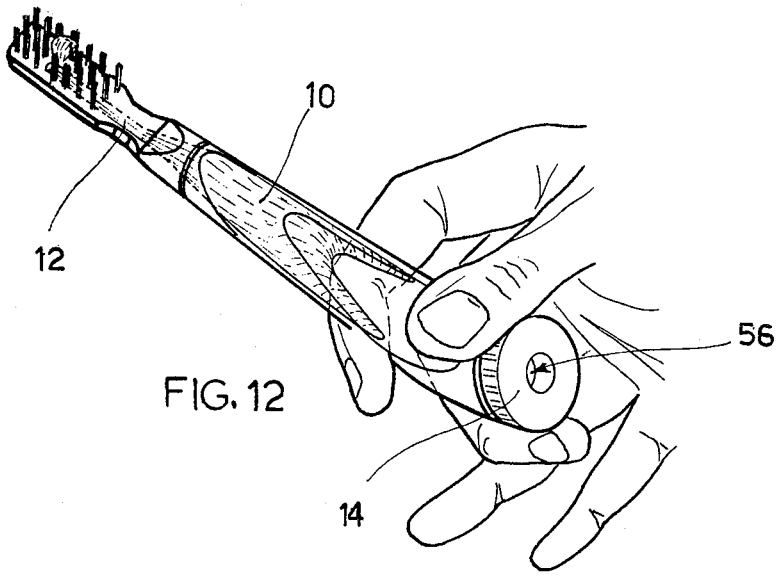
Figure 13:
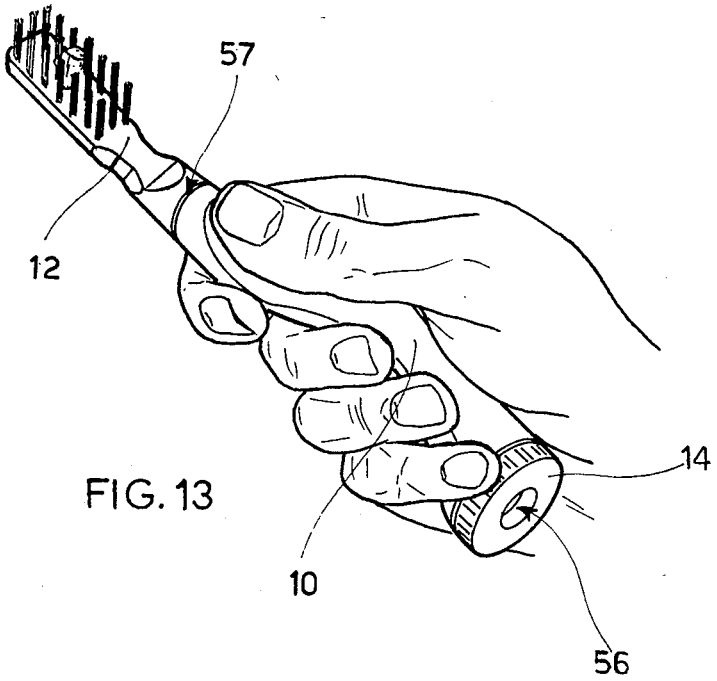

FIGS. 12 and 13 are views of the brush means being squeezed.

The toothbrush (10) with its bristles (11) consists of a brush section (12), a central section (13) and a cap (14). The channel (15) connects the threaded base (16) to the distribution aperture (17). The central section comprises the threaded collar (18) and the end filling aperture (19) with internal thread cut in a disk (20). This latter is welded onto the central section.

The external (21) and internal (22) surfaces of the central section are out of line on the XX axis so that wall thickness decreases little by little from the back (23) towards the front end (24).

Figures 1, 2, 3, 4, 5, 6, 7, 8:
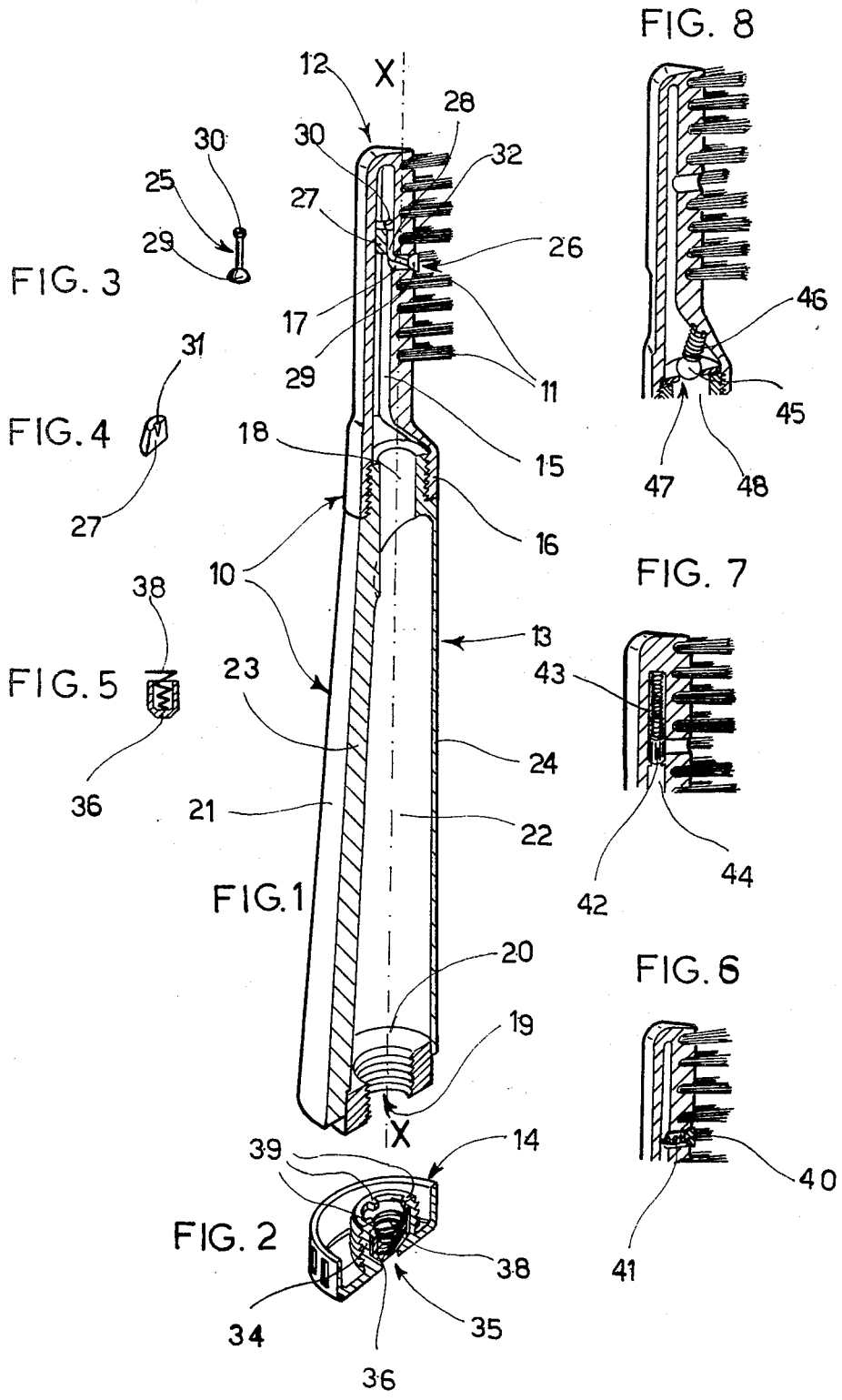
FIG. 1 is a view of the toothbrush.
FIG. 2 is a view of the cap with valve.
FIGS. 3–8 are alternate types of distribution valve means.

The distribution valve is shown both by itself (25) FIG. 3 and mounted (26).

The wedge (27) in FIG. 4 fitted into the semicircular channel (15) holds the part marked (28) of the leg of valve (29) against the wall. The head (30) fits into the conical niche (31) of the wedge itself, the truncated cone-shaped back of which is lodged in the channel (15). The part of the valve leg marked (32) acts as a traction spring. The back hole (19) cut into the disk (20) is closed with a cap (14) provided with a threaded leg (34). This leg has an axial hole with a truncated cone-shaped aperture (35) served by an outlet valve (36) FIG. 5, kept closed by a helical tapered spring (38) lying between the tongues (39) and the bottom of the valve itself.

The mode of operation is quite clear.

The toothpaste, or other suitable product, is put in through the hole (19). The central section during use acts as a handle transmitting the force applied by the hand to the toothbrush onto the teeth. By applying pressure to the flexible front surface, internal pressure is set up which pushes the product, e.g. toothpaste, along the channel of the brush section as far as the distribution valve. This latter, pressed by the paste, overcomes the resistance offered by the flexible leg and opens, allowing the paste to pass among the bristles (11).

Left to itself, the central section (13) resumes its original shape, sucking in an equivalent amount of air, through the valve (36), compared to the product expelled with any air there may have been. The cycle having been completed, both valves close.

FIG. 6 shows another type of distribution valve consisting of a half-sphere (40) served by a traction spring (41).

FIG. 7 shows a sliding piston valve (42) in the extension (43) of the channel (44).

FIG. 8 illustrates another valve formed by the small ball (45) served by the spring (46) which closes the aperture (47) of the container (48).

Figure 9:
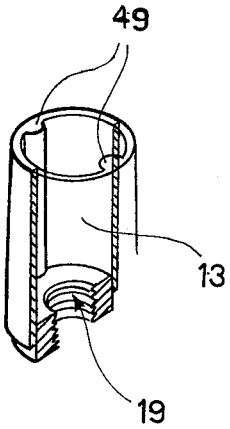

In FIG. 9, the diametral ribbing (49) providing another type of rigidity for the central section, can be seen.

Figure 10:
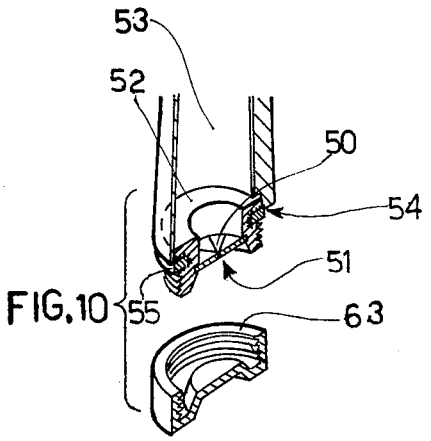
FIGS. 9 and 10 are variations of the central section and filling aperture respectively.

FIG. 10 shows a variation of the filling aperture with a threaded cap 63, consisting of the triangular fins (50) on the lens (51) which fit into the threading on the collars of ordinary toothpaste tubes, to facilitate introduction of the paste.

FIG. 10 also shows a method of joining the disk (52) to the central section (53) by injection molding a plastic collar (55) on the joint (54) thus establishing real structural and molecular continuity.

FIGS. 12 and 13, respectively show how the central section can be completely squeezed, as would be done with an ordinary tube of toothpaste, both near the filling aperture (56) and also near the threaded joint of connection (57) with the brush section without any risk of the different sections coming apart.

FIGS. 11 and 11' shows the cylindrical brush casing (58) divided more or less mid-way along into two halves (59) and (60). Stability of the brush inside it is ensured by a recess (64) which fills the space between the case and the back (61) of the brush section. On the bottom end of the casing there is a mirror (62).

The main advantages of the invention are clearly as follows:

complete utilization of all the paste contained inside;

maximum cleaning action, partly due to rigidity of the middle section;

maximum steady paste flow, due to the two valves, one for distribution and the other for air outlet;

very high hygienic level as both valves automatically close after use;

convenient to use especially when traveling due to the rationally designed cylindrical case with mirror at one end.

As the invention concerned can be applied to other articles and as the description of its application to a toothbrush does not in any way limit a wider application, a request for industrial exclusivity for the concept involved must include every similar application actuated and/or operating in accordance with one or more of the characteristics described in the following

We claim:

1. A device for cleaning teeth with the use of cleaning fluid media, comprising a brush section having a base and an inner passage having a distributing aperture; an elongated container section bounding a hermetically closed inner chamber for accommodating a fluid medium and having an inlet end and an outlet end, said inner chamber communicating at said outlet end with said inner passage of said brush section, said container section having a wall which is sufficiently rigid in a longitudinal direction so that said container section can serve as a handle, and at the same time is sufficiently resiliently deformable in a transverse direction so that said container section can be squeezed to urge the fluid medium accommodated in said inner chamber to flow from the latter to said brush section; a rigid disk at said inlet end of said container section and defining a filling opening of said inner chamber; a detachable cap for closing said filling opening; and one valve arranged to open when said container section is squeezed so as to discharge the fluid medium from said inner chamber of said container section into said inner passage of said brush portion whereafter the fluid medium discharges through said distributing aperture, said one valve having a semi-spherical valve member closing said distributing aperture from outside, a head portion fixed to said base of said brush portion, and a stem connecting said valve member to said head portion, said valve member, head portion and stem being of one-piece with each other with said stem extending through said distributing aperture.

2. A cleaning device as defined in claim 1, wherein said brush section, said container section and said cap are constituted of a synthetic plastic material.

3. A cleaning device as defined in claim 1; and further comprising means for connecting said disc with said container section and including a weld seam integrally connecting them with each other.

4. A cleaning device as defined in claim 1, wherein said container section is an injection molding-produced member having molecular homogeneousness and orderly arranged fibers.

5. A cleaning device as defined in claim 1, wherein said container section has a cylindrical base portion adjacent to said inlet end and a truncated conical portion adjacent to said outlet end and converging from said cylindrical portion to said brush portion.

6. A cleaning device as defined in claim 5, wherein said cylindrical portion of said container section has an outer cross section which is smaller than the outer cross section of said brush portion; and further comprising a substantially cylindrical case arranged to accommodate the cleaning device therein, said case having a first part with an inner cross section substantially corresponding to the outer cross section of said cylindrical portion of said container section, and a second part having an inner cross section substantially corresponding to the outer cross section of said brush section so that the cleaning device laterally abut against and cannot move inside said case.

7. A cleaning device as defined in claim 6, wherein said case has a local depression which forms said second part.

8. A device as defined in claim 1, wherein said wall of said container section has inner and outer circumferential surfaces having axes which are offset relative to one another so that said wall has a thickness differing in a circumferential direction so as to render said wall resiliently deformable in said transverse direction but rigid in said longitudinal direction.

9. A device as defined in claim 1, wherein said inner passage has an extension immediately after said distributing aperture; and further comprising a fixing device including a block tightly fitting into said extension and pressing a part of said head portion of said valve against a wall of said extension of said inner passage.

* * * * *